US006191403B1

(12) United States Patent
Hayakawa et al.

(10) Patent No.: US 6,191,403 B1
(45) Date of Patent: Feb. 20, 2001

(54) HIGH FREQUENCY HEATING COOKING APPARATUS AND MANUFACTURING METHOD THEREOF

(75) Inventors: Yuji Hayakawa, Nara; Ichiro Hori, Yamatokoriyama, both of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/194,636

(22) PCT Filed: May 21, 1997

(86) PCT No.: PCT/JP97/01722

§ 371 Date: Nov. 30, 1998

§ 102(e) Date: Nov. 30, 1998

(87) PCT Pub. No.: WO97/45679

PCT Pub. Date: Dec. 4, 1997

(30) Foreign Application Priority Data

May 31, 1996 (JP) ..... 8-138080

(51) Int. Cl.[7] ..... H05B 6/80
(52) U.S. Cl. ..... 219/756; 219/757; 219/746
(58) Field of Search ..... 219/685, 681, 219/756, 757, 746; 126/21 A

(56) References Cited

U.S. PATENT DOCUMENTS

| | | | | |
|---|---|---|---|---|
| 4,481,396 | * | 11/1984 | Matsubayashi et al. | 219/757 |
| 4,675,507 | * | 6/1987 | Akiyoshi et al. | 219/685 |
| 4,680,439 | * | 7/1987 | Millman | 219/756 |
| 5,111,013 | * | 5/1992 | Okada | 219/756 |

FOREIGN PATENT DOCUMENTS

| | | | | |
|---|---|---|---|---|
| 51-6553 | | 1/1976 | (JP) . | |
| 52-93952 | | 7/1977 | (JP) . | |
| 53-135657 | | 10/1978 | (JP) . | |
| 55-63329 | | 5/1980 | (JP) . | |
| 57-21722 | | 2/1982 | (JP) . | |
| 58-6397 | | 1/1983 | (JP) . | |
| 60-155430 | | 10/1985 | (JP) . | |
| 61-3302 | | 1/1986 | (JP) . | |
| 62-110298 | | 5/1987 | (JP) . | |
| 2-306578 | * | 12/1990 | (JP) | 219/685 |
| 4-244518 | | 9/1992 | (JP) . | |

OTHER PUBLICATIONS

Japanese Search report corresponding to application PCT/JP97/01722 dated Aug. 26, 1997.
English translation of Form PCT/ISA/210.
European Search Report corresponding to application No. EP 97 92 2136 dated Jan. 27, 2000.

* cited by examiner

*Primary Examiner*—Philip H. Leung
(74) *Attorney, Agent, or Firm*—Ratner & Prestia

(57) ABSTRACT

A high frequency heating cooking apparatus is capable of preventing from rusting and reducing the cost substantially at the same time. The heating compartment of the high frequency heating cooking apparatus of the invention comprises a side wall, a top panel, and a bottom panel. By folding and plating one plated steel plate, the side wall having a left side wall, a right side wall, and a back side wall is formed. The plated steel plate has a function of preventing from rusting. The top panel is made of a stainless steel material, and this top panel has a power feed port, an intake hole, and an exhaust hole. The side wall made from a plated steel plate does not have opening ends of holes such as intake hole and exhaust hole.

11 Claims, 4 Drawing Sheets

HIGH FREQUENCY HEATING COOKING APPARATUS AND MANUFACTURING METHOD THEREOF

This application is a U.S. National Phase application of PCT International application PCT/JP97/01722.

1. Technical Field

The present invention relates to a high frequency heating cooking apparatus with a heater or a microwave oven, and more particularly to the constitution of its heating compartment and the method of manufacturing the same.

2. Background Art

The constitution of a heating compartment of a conventional high frequency heating cooking apparatus is described below by referring to FIG. 3 and FIG. 4. A structural diagram of the heating compartment of the conventional high frequency heating cooking apparatus is shown in FIG. 3. A front sectional view of the conventional high frequency heating cooking apparatus is shown in FIG. 4. In FIG. 3 and FIG. 4, the heating compartment is composed of an assembly of a left side wall 101, a right side wall 101, an upper wall 103, a bottom panel 102, and a back panel 104. Each member of the compartment is joined by welding or crimping. Side wall 101 is provided with a power feed port 107 for feeding high frequency electromagnetic waves generated by a magnetron 108 into the heating compartment, and an intake hole 105 for ventilation. Back panel 104 is provided with an exhaust hole 106. The outer side of bottom panel 102 is provided with a lower heater 111, and the outer side of upper wall 103 is provided, with an upper heater 112. At the end junction of bottom panel 102, a flange 110 is provided for preventing the water escaping from junction 109 and propagating into the direction of lower heater 111.

In such conventional constitution of the heating compartment, however, since upper wall 103 and bottom plate 102, in which upper heater 112 and lower heater 111 are provided, are exposed to high temperature, stainless steel materials of high heat resistance are needed. On the other hand, right and left side walls 101 are low in temperature, and do not need expensive stainless steel materials.

In the conventional constitution, since left side wall 101, right side wall 101, and upper wall 103 form an integral structure, stainless steel materials must be used, resulting in a cost increase.

In side wall 101 and back panel 104, if plated steel plates other than stainless steel are used, rust is formed in side wall 101 and in portions other than the plated layers. Rust is also formed in the end portion of the holes of power feed port 107, intake hole 105, and exhaust hole 106.

Another problem is the increase of material cost of providing flange 110 to avoid insulation failure and prevent water leaks from junction 109 of side wall 101 and water propagating from bottom panel 102 into lower heater 111.

It is hence an object of the present invention to provide a high frequency heating cooking apparatus capable of preventing rust, reducing cost, and insulating the heater easily.

DISCLOSURE OF THE INVENTION

A high frequency heating cooking apparatus of the present invention comprises a heating compartment having a left side wall, a right side wall, back side wall, a bottom panel, and a top panel, for containing and heating food therein, a magnetron installed outside of the heating compartment, for generating a high frequency electric power, a duct for leading the high frequency electric power into the heating compartment, and a heater installed at an outside of the heating compartment. The heater is installed outside of at least one of the bottom panel and the top panel. The left side wall, the right side wall, and the back side wall are formed integrally in one plate.

The inner surface of each one of the left side wall, the right side wall, and the back side wall is a treated steel plate.

A manufacturing method of high frequency heating cooking apparatus of the invention comprises:

(1) a step of manufacturing a heating compartment, (2) a step of installing a magnetron for generating a high frequency electric power outside of the heating compartment, (3) a step of installing a duct for leading the high frequency electric power into the heating compartment, and (4) a step of installing a heater outside of the heating compartment.

The heating compartment is manufactured in (a) a step of folding and processing a steel plate to form side walls having a left side wall, a right side wall, and a back side wall, (b) a step of joining a top panel above the walls, (c) a step of joining a bottom panel below the side walls, and (d) a step of placing a door to be opened and closed, before the side walls.

Preferably, each one of the left side wall, the right side wall, and the back side wall does not have a hole or opening cut section end portion .

Preferably, the surface treated steel plate is a plated steel plate having a function of preventing rust.

Preferably, the surface treated steel plate is aluminum plated steel plate.

Preferably, the surface treated steel plate is painted steel plate.

Preferably, the surface treated steel plate is fluorine resin coated steel plate.

Preferably, the top panel is formed of a stainless steel having a function of preventing rust.

Preferably, the top panel has an intake hole, an exhaust hole, and a power feed port for feeding the high frequency electric power into the heating compartment formed at specified positions.

In the above constitution, the side wall of the heating compartment composed of left side wall, right side wall, and back side wall is a surface treated steel plate integrally formed in a pi-form or U-form.

Hence, rust is prevented, and the manufacturing cost is reduced at the same time. More particularly, notable effects are obtained when the surface treated steel plate aluminum plated steel plate or fluorine resin coated steel plate.

Moreover, the top panel is formed of stainless steel, and penetration holes such as power feed opening, intake hole and exhaust hole are formed in the stainless steel, The side wall made of steel plate does not have any penetration hole. Accordingly, if inexpensive plated steel plate is used in the side wall, rust is prevented in the apparatus since it does not have a hole opening cut section end portion.

Still more, the heater is installed outside of the top panel or bottom panel made of stainless steel, and is not installed at the side wall made of steel plate. Hence, if inexpensive plated steel plate is used in the side wall, a reliable heat resistant high frequency heating cooking apparatus can be obtained. As a result, manufacturing cost is lowered.

In addition, the heater is installed at the lower side of the bottom plate. A bead form reducing portion is formed near the end of the inside surface of the bottom panel, preventing water generated inside from passing through the junction part and contacting the heater.

As a result, an excellent electric insulation of the heater is guaranteed.

DETAILED DESCRIPTION

An exemplary embodiment of a high frequency heating cooking apparatus of the invention is described below by referring to FIG. 1 and FIG. 2.

Figure 1:
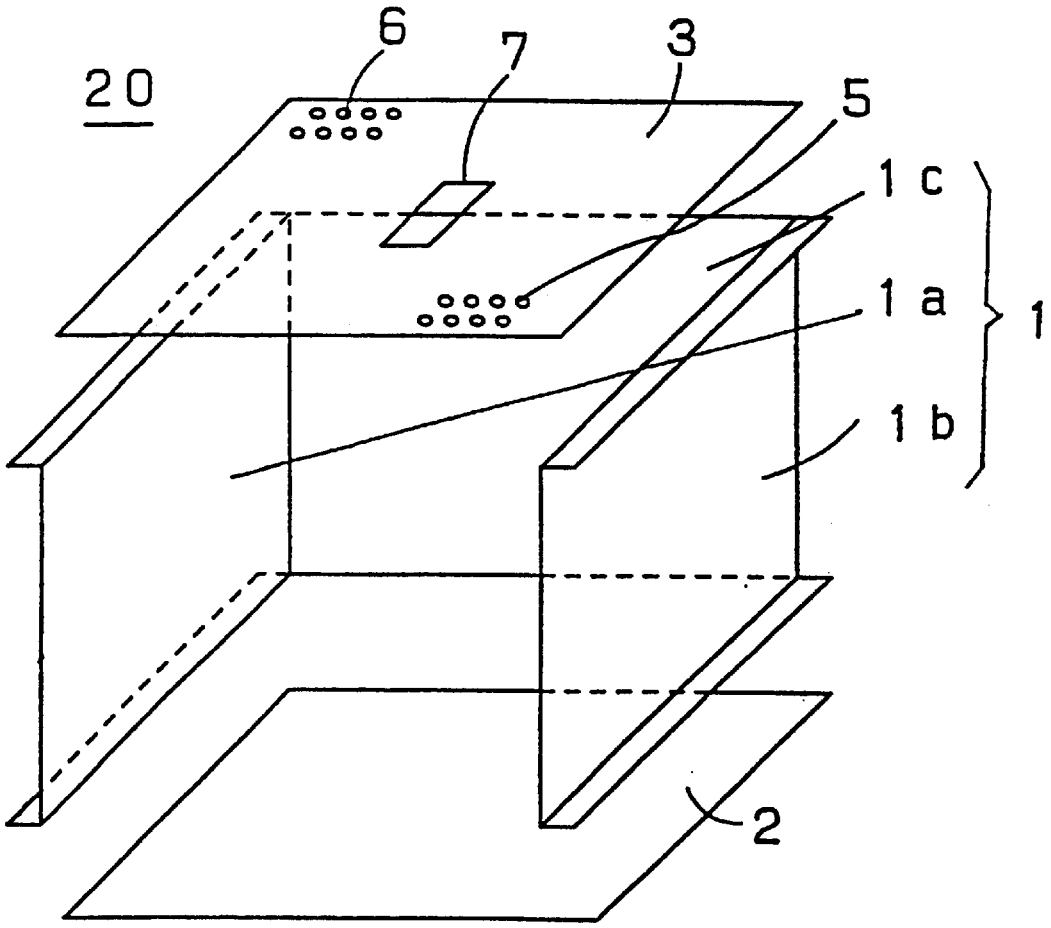
FIG. 1 is a perspective view of the assembly constitution of a heating compartment of a high frequency heating cooking apparatus in one exemplary embodiment of the present invention.
Figure 2:
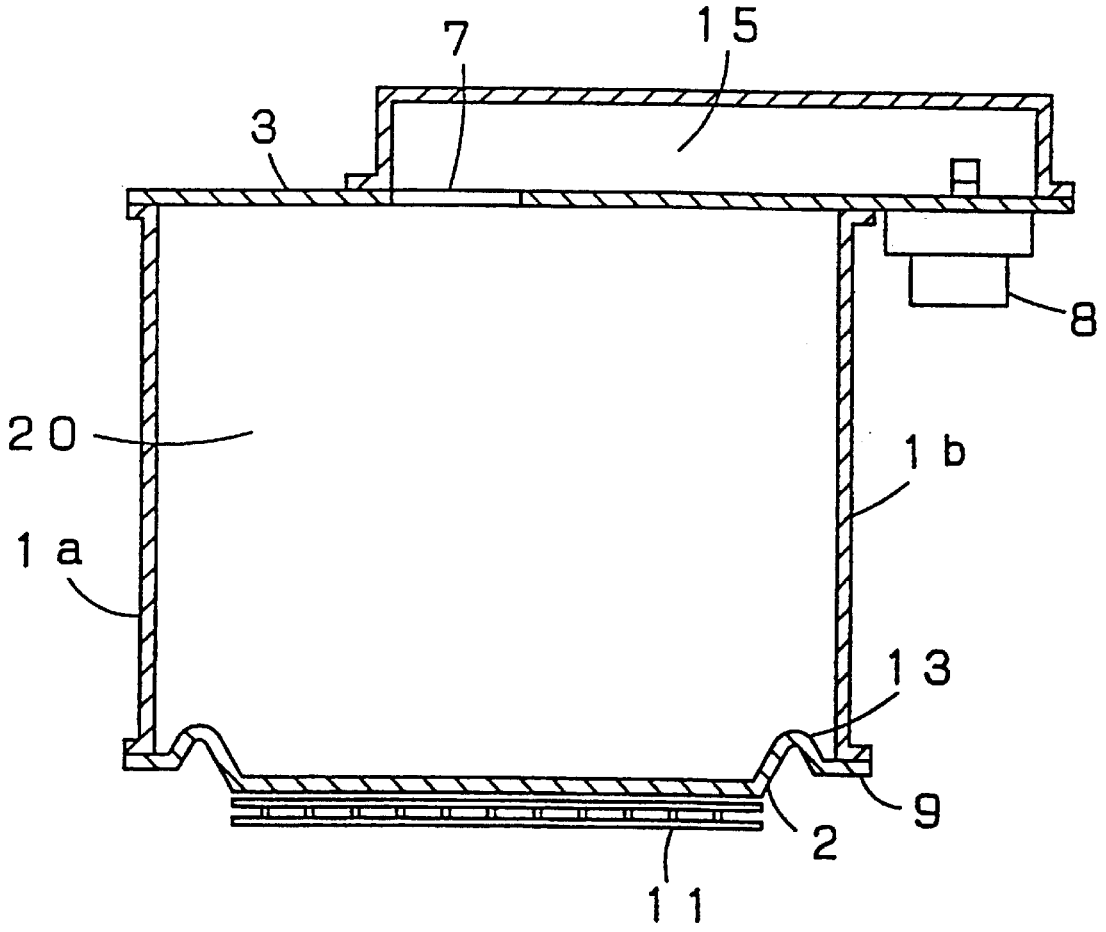
FIG. 2 is a front sectional view of a high frequency heating cooking apparatus in another exemplary embodiment of the present invention.
Figure 3:
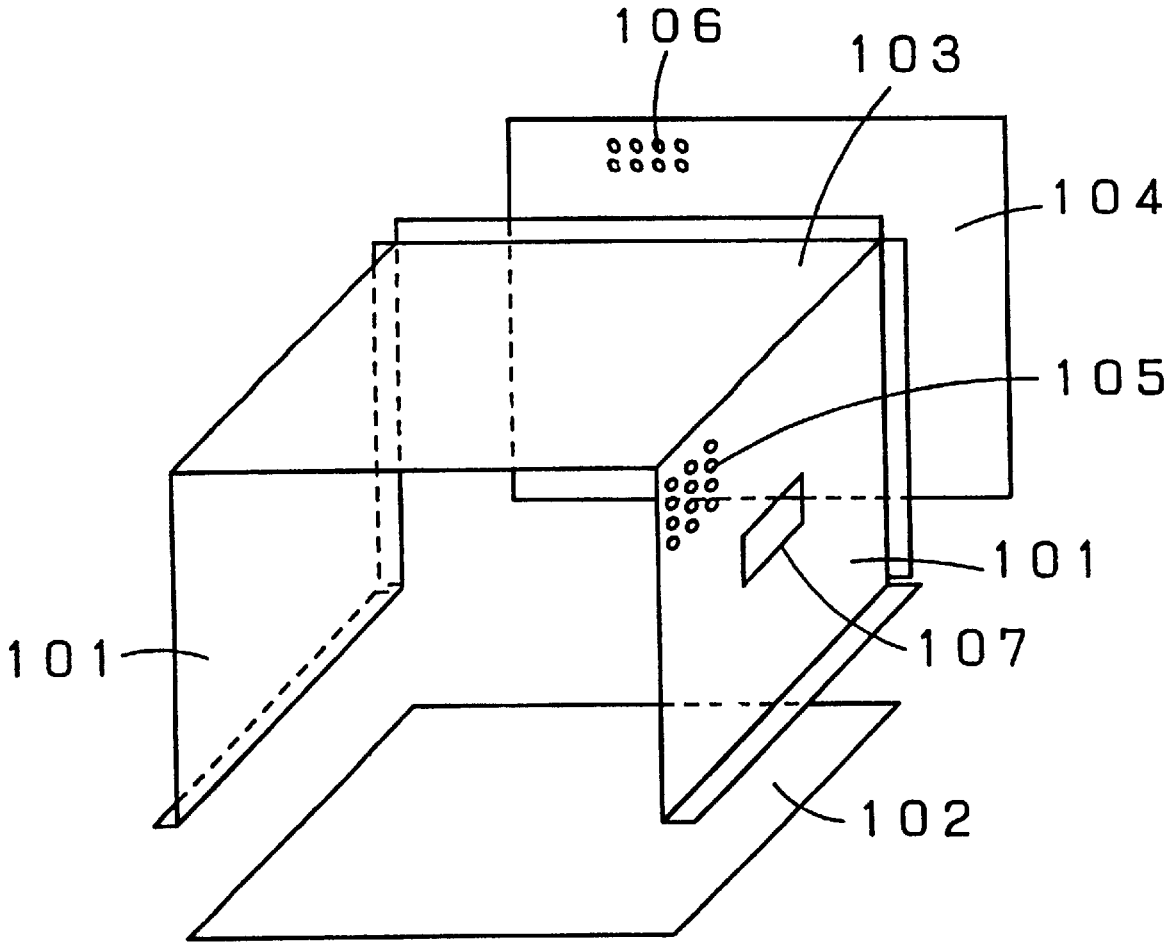
Fig. 3 PRIOR ART
FIG. 3 is a perspective view of the constitution of a heating compartment of a high frequency heating cooking apparatus of the prior art.
Figure 4:
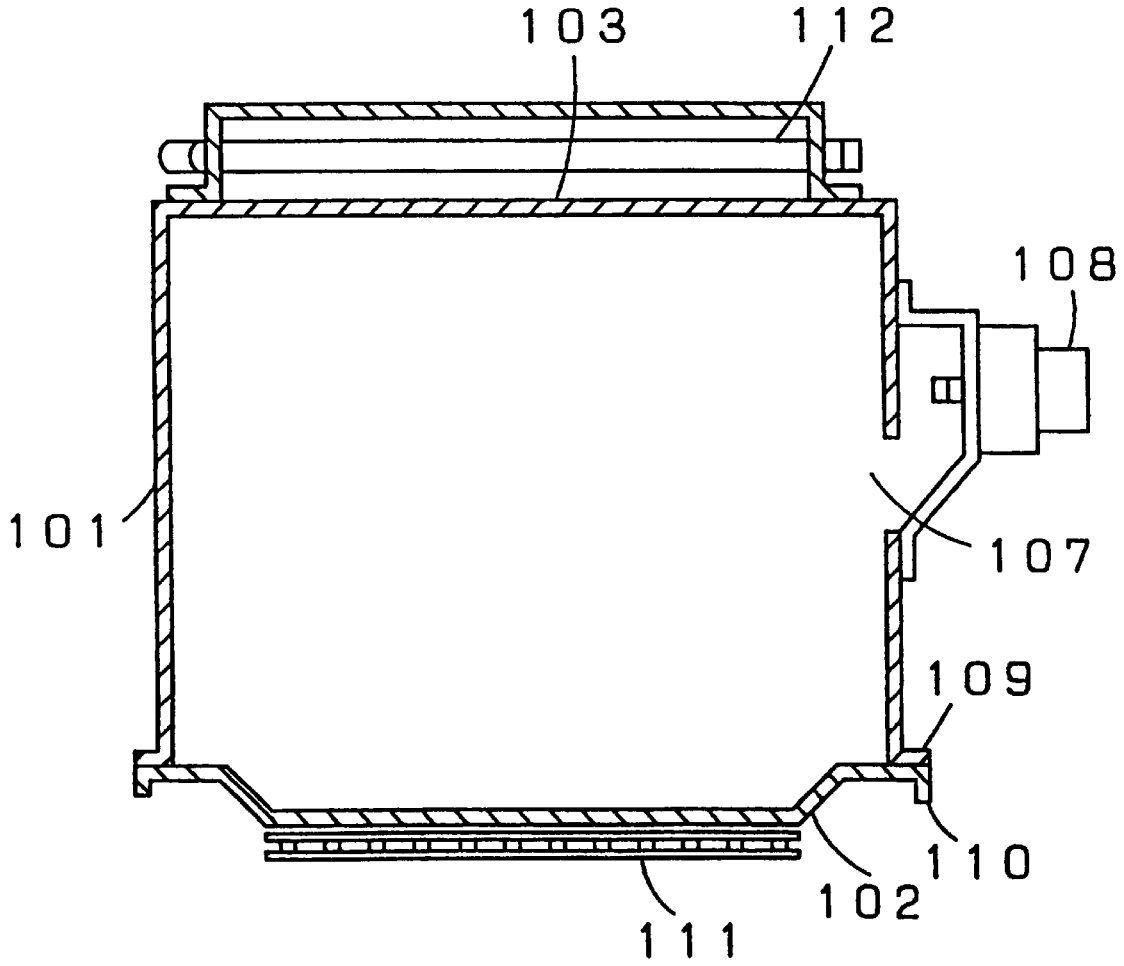
Fig. 4 PRIOR ART
FIG. 4 is a front sectional view of a high frequency heating cooking apparatus of the prior art.

A perspective view for explaining the constitution of an embodiment of a high frequency heating cooking apparatus of the invention is shown in FIG. 1, and its front sectional view is given in FIG. 2. In FIG. 1 and FIG. 2, a heating compartment 20 for heating food is composed of a nearly rectangular parallelepiped having a left side wall 1*a*, a right side wall 1*b*, a back side wall 4, a top panel 3, a bottom panel 4, and a door. A lower heater 11 is provided outside of bottom panel 2, and an upper heater (not shown) outside of top panel 3. At the outside of heating compartment 20, magnetron 8 for generating high frequency electromagnetic waves, and waveguide 15 are installed.

Top panel 3 is manufactured from a stainless steel material.

Stainless steel has an excellent heat resistance and prevents rust . Power feed port 7, intake hole 5, and exhaust hole 6 are formed in top panel 3. At the upper side of top panel 3, waveguide 15 is installed between power feed port 7 and magnetron 8. The high frequency electromagnetic waves generated by magnetron 9 are guided into heating compartment 20 through waveguide 15 and power feed port 7. Intake hole 5 has plural tiny penetration holes, and plays the role of taking in the air for ventilation inside heating compartment 20. Exhaust hole 6 has plural tiny penetration holes, and plays the role of exhausting steam or gas generated in heating compartment 20 to the outside. It is preferred that intake hole 5 be formed at a remote position from exhaust hole 6. Intake hole 5, exhaust hole 6, and power feed port 7 are formed, for example, by blanking.

The left side wall 1*a*, right side wall 1*b*, and back side wall 1*c* are integrally composed into a pi-form or a U-form. That is, side wall 1 composed of left side wall 1*a*, right side wall 1*b*, and back side wall 1*c* is an integral structure manufactured by folding and processing one plate material. Moreover, left side wall 1*a*, right side wall 1*b*, and back side wall 1*c* do not have holes such as intake holes and exhaust holes. Side wall 1 composed of left side wall 1*a*, right side wall 1*b*, and back side wall 1*c* is manufactured from a surface treated steel plate. The door is installed at the front side of the heating compartment so as to be opened and closed.

Side wall 1 and bottom panel 2 are joined by welding, caulking or crimping. Side wall 1 and top panel 3 are joined by welding or crimping.

The surface treated steel plate used in side wall 1 composed of the left side wall 1*a*, right side wall 1*b*, and back side wall 1*c* is preferably a surface plated steel plate for preventing rust.

In addition to the plated steel plate, an aluminum plated steel plate can be used.

Bottom panel 2 is manufactured from stainless steel material. Stainless steel has an excellent heat resistance property and prevents rust.

In bottom panel 2 near junction 9 of side wall 1 and bottom plate 2, a protruding reducing portion 13 in a bead form is formed. If moisture released from the food in the heating compartment or if water used when cleaning the inside of the heating compartment escapes from junction 9, it is captured by reducing portion 13, and is not propagated to lower heater 11.

In this constitution, the cooking material is put into the heating compartment 20, and the cooking material is heated and cooked by application of magnetron 8 or heater 11. At this time, the air in the heating compartment 20 flows by convection in heating compartment 20, and part of the air is discharged to the outside of heating compartment 20 through exhaust hole 6, while fresh air flows into heating compartment 20. At this time, part of the steam generated from the cooking material is discharged outside of heating compartment 20 through exhaust port 6.

In this constitution, the following action and effect are obtained.

Since side wall 1 is distant from lower heater 11 and upper heater, it is not heated to high temperature.

Therefore, the plated steel plate used in side wall 1 can sufficiently maintain a reliable temperature. Moreover, since the plated steel plate is generally less expensive than the stainless steel, the material cost of side wall 1 is saved.

Generally speaking, rust due to temperature and moisture is likely to occur in the cut section ends of the opening of intake hole 5, exhaust hole 6, and power feed port 7. In this embodiment, however, since intake hole 5, exhaust hole 6, and power feed power 7 are formed on the top panel which is made of stainless steel which prevents rust, rust is not formed. Moreover, since the side wall 1 made of plated steel plate does not have cut sections of penetration holes or opening, rust is not formed at the end face of the holes. As a result, a rust-free heating compartment is obtained.

By the constitution of forming projecting reducing portion 13 in bottom panel 2 near junction 9 of side wall 1 and bottom panel 2, water in the heating compartment 20 is prevented from escaping from bottom panel 2, so that the electric insulation of lower heater 11 can be easily assured.

In the embodiment, to enhance prevention of contamination of the inner wall of the heating compartment, it is also possible to apply a resin paint on the inner surface of the side wall. As the fluorine resin, for example, fluorocarbon can be used. For instance, as the material for the side wall 1, a painted steel plate of fluorine resin may be used on the surface of the steel plate. Application of fluorine resin on the steel plate is extremely easy. In this constitution, the same action and effect as mentioned above can be obtained.

Industrial Applicability

Thus, in the high frequency cooking apparatus of the present invention, expensive stainless steel in the side wall is not required, rather inexpensive plated steel plate can be used, preventing rust on the surface end hole, and substantially reducing cost.

Besides, by forming a bead form reducing portion near the junction of the bottom panel of the heating compartment, water escaping from the junction is not propagated up to the heater, so that insulation of the heater can be assured in a simple constitution.

What is claimed is:

1. A high frequency heating cooking apparatus comprising:

a heating compartment having a left side wall, a right side wall, a back side wall, a bottom panel, and a top panel, for containing and heating food therein, a magnetron for generating a high frequency electric power, a duct for leading said high frequency electric power into said heating compartment, and a heater installed outside at least one of said bottom panel and said top panel, and wherein an inner surface of each of said left side wall, said right side wall, and said back side wall is treated steel plate, said top panel having an intake opening, an exhaust opening, and a power feed opening for feeding said high frequency electric power into said heating compartment, said intake opening, exhaust opening, and power feed opening in the same plane which is parallel to the bottom panel.

2. A high frequency heating cooking apparatus of claim 1, wherein each of said left side wall, said right side wall, and said back is a continuous planar sheet.

3. A high frequency heating cooking apparatus of claim 1, wherein said surface treated steel plate is a plated steel plate.

4. A high frequency heating cooking apparatus of claim 1, wherein said surface treated steel plate is an aluminum plated steel plate.

5. A high frequency heating cooking apparatus of claim 1, wherein said surface treated steel plate is a painted steel plate.

6. A high frequency heating cooking apparatus of claim 1, wherein said surface treated steel plate is a fluoride resin coated steel plate.

7. A high frequency heating cooking apparatus of claim 1, wherein said top panel is formed of stainless steel material.

8. A high frequency heating cooking apparatus of claim 1, each one of said left side wall, right side wall, and back side wall having a junction portion bonded to said bottom panel, wherein a bead form reducing portion is formed near an end of the inner surface of said bottom panel for stopping, flow of water generated inside of said heating compartment.

9. A high frequency heating cooking apparatus of claim 1, said surface treated steel plate is a plated steel plate, said surface treated steel plate is a planar sheet, and said top panel is formed of stainless steel material.

10. A high frequency heating cooking apparatus of claim 1, wherein said heater is installed at a lower side of said bottom panel, said surface treated steel plate is a plated steel plate, said surface treated steel plate is a planar sheet, and said top panel is formed of stainless steel material.

11. A high frequency heating cooking apparatus of claim 1, wherein said left side wall, said right side wall and said back side wall are formed integrally of one plate.

* * * * *